US010508867B2

(12) United States Patent
Dowell, Jr. et al.

(10) Patent No.: US 10,508,867 B2
(45) Date of Patent: Dec. 17, 2019

(54) CORROSION RESISTANT COAXIAL HEAT EXCHANGER ASSEMBLY

(71) Applicant: Dometic Sweden AB, Solna (SE)

(72) Inventors: Gary L. Dowell, Jr., Pompano Beach, FL (US); James E. Sims, Deerfield Beach, FL (US)

(73) Assignee: Dometic Sweden AB, Solna (SE)

( * ) Notice: Subject to any disclaimer, the term of this patent is extended or adjusted under 35 U.S.C. 154(b) by 61 days.

(21) Appl. No.: 15/167,571

(22) Filed: May 27, 2016

(65) Prior Publication Data

US 2016/0348988 A1 Dec. 1, 2016

Related U.S. Application Data

(60) Provisional application No. 62/167,828, filed on May 28, 2015.

(51) Int. Cl.
*F28D 7/10* (2006.01)
*F28F 19/00* (2006.01)
(Continued)

(52) U.S. Cl.
CPC ..... *F28D 7/106* (2013.01); *F28D 7/022* (2013.01); *F28D 7/103* (2013.01); *F28D 7/14* (2013.01); *F28F 9/0246* (2013.01); *F28F 9/26* (2013.01); *F28F 19/00* (2013.01); *F28F 21/083* (2013.01); *F28F 21/085* (2013.01);
(Continued)

(58) Field of Classification Search
CPC .. F28F 9/0246; F28F 9/26; F28F 19/00; F28F 21/083; F28F 21/085; F28F 21/086; F28F 2275/025; F28F 2275/04; F28F 2275/10; F28F 2275/12; F28F 2275/18;
(Continued)

(56) References Cited

U.S. PATENT DOCUMENTS 2,034,553 A * 3/1936 Askin ..... F25B 40/00 165/154
2,410,912 A 11/1946 Wenk
(Continued)

FOREIGN PATENT DOCUMENTS

CN 2816769 9/2006
CN 2819192 9/2006
(Continued)

OTHER PUBLICATIONS

Machine translaiton of JP 03238128 A, retrieved Nov. 6, 2017.*
(Continued)

*Primary Examiner* — Christopher R Zerphey
*Assistant Examiner* — Hans R Weiland
(74) *Attorney, Agent, or Firm* — Middleton Reutlinger

(57) ABSTRACT

A heat exchanger assembly is provided which includes a coaxial heat exchanger that is formed, at least in part, of a more corrosion resistant material such as, but not limited to stainless steel, titanium and/or alloys thereof. The assembly further includes a condenser tee connected at each end of the coaxial conduit or tubing defining the heat exchanger. The assembly allows for a non-brazed connection of the condenser tee to an inner tube of the coaxial heat exchanger. In some embodiments, the compression fitting may be connected directly to the heat exchanger without the use of a tee.

30 Claims, 11 Drawing Sheets

(51) Int. Cl.

| | |
|---|---|
| ***F28F 9/02*** | (2006.01) |
| ***F28F 9/26*** | (2006.01) |
| ***F28D 7/02*** | (2006.01) |
| ***F28D 7/14*** | (2006.01) |
| ***F28F 21/08*** | (2006.01) |

(52) U.S. Cl.
CPC ..... *F28F 21/086* (2013.01); *F28F 2275/025* (2013.01); *F28F 2275/04* (2013.01); *F28F 2275/12* (2013.01)

(58) Field of Classification Search
CPC ..... F28D 7/022; F28D 7/103; F28D 7/106; F28D 7/14; F28D 7/10; F25B 39/04
See application file for complete search history.

(56) References Cited

U.S. PATENT DOCUMENTS

| | | | | |
|---|---|---|---|---|
| 4,032,177 | A * | 6/1977 | Anderson | F16L 33/224 285/24 |
| 4,865,004 | A * | 9/1989 | Widmer | F28D 7/106 123/541 |
| 6,098,704 | A | 8/2000 | Tsuchiya | |
| 6,102,106 | A * | 8/2000 | Manning | F28F 9/0246 165/163 |
| 6,550,815 | B2 | 4/2003 | Zitkowic, Jr. et al. | |
| 7,686,346 | B1 | 3/2010 | Buccicone et al. | |
| 7,886,420 | B2 * | 2/2011 | Naganawa | F28D 7/106 29/507 |
| 8,414,034 | B2 * | 4/2013 | Williams | F28F 9/0246 285/15 |
| 2002/0157815 | A1 | 10/2002 | Sutter | |
| 2003/0209345 | A1 * | 11/2003 | Zweig | F28D 7/022 165/154 |
| 2008/0048448 | A1 * | 2/2008 | Jamison | F16L 13/141 285/382.2 |
| 2009/0159248 | A1 * | 6/2009 | Mimitz, Sr. | F28D 7/106 165/154 |
| 2009/0260586 | A1 * | 10/2009 | Geskes | F28D 7/106 123/41.48 |
| 2011/0214847 | A1 * | 9/2011 | Hur | F28D 7/106 165/143 |
| 2011/0241333 | A1 | 10/2011 | Borgmeier et al. | |
| 2012/0298342 | A1 | 11/2012 | Shen | |
| 2012/0325450 | A1 * | 12/2012 | Mimitz | F28D 7/106 165/177 |
| 2015/0168074 | A1 * | 6/2015 | Bariar | F28D 7/106 165/154 |
| 2016/0348988 | A1 | 12/2016 | Dowell, Jr. et al. | |

FOREIGN PATENT DOCUMENTS

| | | | | |
|---|---|---|---|---|
| CN | 102116585 | | 7/2011 | |
| CN | 203622853 | | 6/2014 | |
| CN | 203622860 | | 6/2014 | |
| CN | 203622866 | | 6/2014 | |
| CN | 203718213 | | 7/2014 | |
| CN | 103776285 | | 9/2015 | |
| CN | 103808185 | | 11/2015 | |
| DE | 3114297 | | 11/1982 | |
| EP | 2515062 | | 10/2012 | |
| JP | 03238128 | A * | 10/1991 | F28D 7/106 |
| JP | H03238128 | | 10/1991 | |
| JP | 2009204166 | | 11/2009 | |
| KR | 20120112560 | | 10/2012 | |
| WO | 2011072470 | | 6/2011 | |
| WO | 2016189520 | | 12/2016 | |

OTHER PUBLICATIONS

Cool and Curly Counterflow Chiller, http://smokedprojects.blogspot.com/2013/02/cool-and-curly-counterflow-chiller.html Sep. 2, 2013.
Build a Counterflow Chiller, http://barleypopmaker.info/2012/10/10/brewing-project-build-a-counterflow-chiller-no-solder-method/ Jan. 12, 2015.
DIY Counterflow Chiller, http://finnhillbrewing.blogspot.com/2011/11/diy-counterflow-chiller.html Nov. 18, 2011.
European Patent Office, International Search Report and Written Opinion for PCT/IB2016/053156 dated Jan. 25, 2017.
Vulkan Group; Lokring. The Best Connection. http://www.vulkan.com/en/vulkan_lokring/htm Nov. 12, 2014.
Transmittal Letter of Related Cases.

* cited by examiner

CORROSION RESISTANT COAXIAL HEAT EXCHANGER ASSEMBLY

CLAIM TO PRIORITY

This Non-Provisional application claims the benefit under 35 U.S.C. § 119 of U.S. Provisional Patent Application Ser. No. 62/167,828 filed May 28, 2015, titled Condenser Tee for Coaxial Heat Exchanger.

BACKGROUND

1. Field of the Invention

Present embodiments generally relate to a coaxial heat exchanger assembly.

More specifically, but without limitation, present embodiments relate to a coaxial heat exchanger assembly having a condenser tee, wherein the heat exchanger is formed of, at least in part, corrosion resistant materials which are difficult or impossible to braze.

2. Description of the Related Art

Coaxial heat exchangers are utilized in various marine chillers. The coaxial heat exchanger is formed of a tube in tube design wherein refrigerant typically flows through an exterior tube and marine water typically flows in the inner tube.

Generally, the coaxial heat exchangers also comprise a tee near each end of the heat exchanger. The tee must have a leak free connection at each opening of the tee. Normally this is provided by brazing the tee at all three connections.

However, the process of brazing becomes problematic if certain metals or alloys are utilized. For example it may be desirable in marine settings to utilize stainless steel, titanium or related alloys for the tubing material in the coaxial heat exchanger. The titanium and stainless steel materials are known to be more robust in seawater. However, these materials can be difficult to braze.

It would be desirable to provide an improved condenser tee and heat exchanger having a leak-free connection between the tee and the coaxial tubing and which does not require brazing of all three connections to the tee. Further, it would be desirable to accommodate the use of corrosion resistant materials for at least a portion of the heat exchanger.

The information included in this Background section of the specification, including any references cited herein and any description or discussion thereof, is included for technical reference purposes only and is not to be regarded subject matter by which the scope of the invention is to be bound.

SUMMARY

Present embodiments provide a heat exchanger assembly including a coaxial heat exchanger with condenser tee. The heat exchanger includes coaxial tubing that is formed, at least in part, of a corrosion resistant material such as stainless steel or titanium. The assembly of further comprises a tee connected at each end of the coaxial conduit or tubing. The assembly allows for a non-brazed connection of the condenser tee to an inner tube of the coaxial heat exchanger wherein at least the inner conduit is formed of titanium or stainless steel.

According to some embodiments, a coaxial heat exchanger assembly comprises a tee formed of at least one of copper, copper-alloy, brass, brass-alloy, a combination of copper and brass, a combination of copper-alloy and brass-alloy or a combination of any of the foregoing, the tee having a first port, a second port and a third port. One of the first and second ports tapers in diameter from a larger size to a smaller size, and wherein the one of said first port and second port comprises an interference fit compression fitting. The third port receives a refrigerant tube. The other of the first port and second port receives a coaxial heat exchanger including an inner conduit of a first material which is relatively more resistant to corrosion, and an outer jacket of a second material which is relatively less resistant to corrosion. The refrigerant tube provides a refrigerant to flow on an outside of said inner conduit, and the inner conduit is configured to receive a more corrosive fluid. Further, the inner conduit extends through the tee and the first port and the compression fitting eliminates a brazing of the inner tube to said tee, while the second port and the third port comprise at least one of brazing or a high temperature high pressure resin.

Optionally, the coaxial heat exchanger assembly may be capable of withstanding temperature above 150° F. The compression fitting may comprise an adapter and a compression ring. The coaxial heat exchanger assembly may have a burst pressure of at least about 500 psig and up to about 2375 psig. The third port may be extending from the condenser tee in plane of the first and second ports. The third port may extend from the tee at about 90 degrees to the first and second ports. The third port may extend toward an interior of a coil shape defined by the heat exchanger. The corrosive fluid may be saltwater and the saltwater may flow in a first direction through the heat exchanger and the refrigerant flows in the first direction. Alternatively, the saltwater may flow in a first direction and the refrigerant may flow in a second direction. The outer jacket may have a plurality of partitions. The partitions may be defined by a plurality of partition walls. The partition walls may extend radially or at an angle to a radial.

According to a second embodiment, a coaxial heat exchanger assembly comprises a first condenser tee, a coaxial heat exchanger having a first end and a second end, said first end connected to said first condenser tee, and said second end connected to a second condenser tee, the heat exchanger having an inner conduit formed of one of titanium, stainless steel or alloys thereof and an outer jacket, the first and second condenser tees each having three ports wherein a first port is in flow communication with saltwater, the third port is in flow communication with a refrigerant and a second port is in flow communication with the heat exchanger wherein both of the saltwater and the refrigerant pass for heat exchange, the second and third port being connected to tubing by one of high pressure high temperature resin or brazing, the first port being connected to the inner conduit by a compression fitting comprising an adapter formed of a braze compatible material with said tees, and a compression ring which engages the adapter and seals the titanium inner conduit to the second port, the adapter having a first diameter which engages the outer jacket and a second diameter which engages the inner conduit.

Optionally, the heat exchanger may form a coil shape. The third port of the condenser tee may extend inwardly of the coil. The third port may extend in a plane of one of the conduit coils. The third port may be one of perpendicular or non-perpendicular to the first and second ports. The condenser tee may have one of said ports tapered from a first diameter to a second diameter between the first port and the second port. The adapter may be brazed to the condenser tee. The tee may have a port which accommodates a change in diameter between the outer jacket to the inner jacket. Alternatively, the adapter may have a first diameter and a second diameter which accommodates a change in diameter between the outer jacket to the inner jacket. In some embodiments, both of the tee and the adapter accommodate a change in diameter between the outer jacket and the inner conduit.

According to a further embodiment, a coaxial heat exchanger assembly, comprises a first condenser tee, a coaxial heat exchanger having a first end and a second end, the first end connected to the first condenser tee, and the second end connected to a second condenser tee, the heat exchanger having an inner conduit formed of one of titanium, stainless steel or alloys thereof and an outer jacket, the first and second condenser tees having three ports wherein a first port is in flow communication with saltwater, the third port is in flow communication with a refrigerant and a second port is in flow communication with the heat exchanger wherein both of the saltwater and the refrigerant pass for heat exchange. The second and third ports may be connected to tubing by one of high pressure high temperature resin or brazing. The first port may be connected to the inner conduit by a compression fitting comprising an adapter which is braze compatible with said condenser tee, and a compression ring which engages the adapter and seals the inner conduit to the second port.

According to some embodiments, a coaxial heat exchanger assembly, comprises a condenser tee, a coaxial heat exchanger connected to the condenser tee, the heat exchanger comprising an outer jacket and an inner conduit, the heat exchanger having an inner conduit formed of one of titanium, stainless steel or alloys thereof and an outer jacket formed of a braze compatible material with said condenser tee, the condenser tee having three ports wherein a first port capable of flow communication with a more corrosive fluid, said third port is in flow communication with a refrigerant and a second port is in flow communication with said heat exchanger wherein both of said more corrosive fluid and said refrigerant pass for heat exchange, the second and third ports being connected to the heat exchanger and a refrigerant tubing by at least one of high pressure high temperature resin or brazing, the first port being connected to the inner conduit by a compression fitting comprising an adapter which is braze compatible with said condenser tee, and a compression ring which engages said adapter and seals the inner conduit to the second port.

According to a further embodiment, a coaxial heat exchanger assembly, comprises a coaxial heat exchanger having a first inner conduit formed of a first more corrosion resistant material and a second outer jacket formed of a second less corrosion resistant material, the outer jacket varying from a larger diameter to a smaller diameter, a port disposed in the outer jacket configured to receive a refrigerant conduit for fluid communication of a refrigerant with an outer surface of the inner conduit, a compression fitting disposed on the smaller diameter of the outer jacket, the compression fitting comprising an adapter which engages the outer jacket in a first location and which engages the inner conduit at a second location, a ring which is positioned on the adapter to tighten the adapter against the first inner conduit.

Optionally, the assembly may further comprise a sealant disposed between the adapter and the inner conduit. The adapter may comprise a first flange which is connected to the heat exchanger and a second flange which is connected to the inner conduit by the ring. The first more corrosion resistant material may be one of titanium, stainless steel or an alloy of at least one of titanium or stainless steel. The second less corrosion resistant material may be one of copper or copper alloy. The first and second materials may be the same material.

According to a further embodiment, a coaxial heat exchanger assembly comprises a coaxial heat exchanger having a first inner conduit formed of a first more corrosion resistant material and a second outer jacket formed of a second less corrosion resistant material, a port disposed in the outer jacket configured to receive a refrigerant conduit for fluid communication of a refrigerant with an outer surface of the inner conduit, a compression fitting comprising an adapter having a first diameter and a second diameter, the first diameter of the adapter engaging the outer jacket at a first location and the second diameter engaging the inner conduit at a second location, a ring which is positioned on the adapter to tighten the adapter against the first inner conduit.

Optionally, the heat exchanger adapter may be tapered.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. All of the above outlined features are to be understood as exemplary only and many more features and objectives of the various embodiments may be gleaned from the disclosure herein. Therefore, no limiting interpretation of this summary is to be understood without further reading of the entire specification, claims and drawings, included herewith. A more extensive presentation of features, details, utilities, and advantages of the present invention is provided in the following written description of various embodiments of the invention, illustrated in the accompanying drawings, and defined in the appended claims.

BRIEF DESCRIPTION OF THE DRAWINGS

In order that the embodiments might be better understood, embodiments of a heat exchanger assembly with condenser tee will now be described by way of example. These embodiments are not intended to limit the scope of the claims, as other embodiments of the heat exchanger assembly and condenser tee will become apparent to one having ordinary skill in the art upon reading the instant description, including but not limited to combinations of features and/or embodiments not expressly shown. Non-limiting examples of the present embodiments are shown in figures wherein:

DETAILED DESCRIPTION

Figure 1:
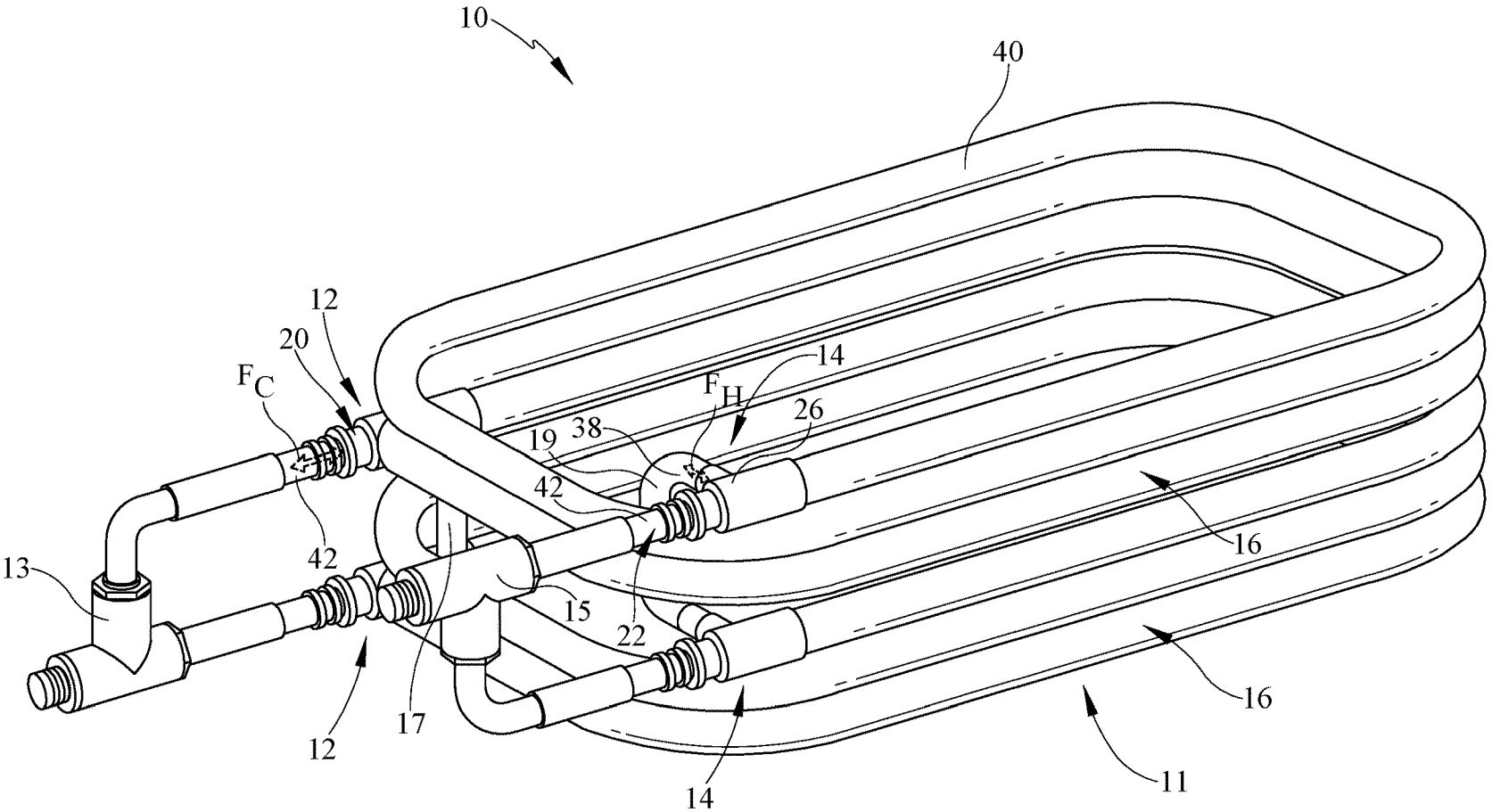
FIG. 1 is a perspective view of a heat exchanger assembly including a condenser tee.

It is to be understood that the heat exchanger assembly with condenser tee is not limited in its application to the details of construction and the arrangement of components set forth in the following description or illustrated in the drawings. The described embodiments are capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Referring now in detail to the Figures, wherein like numerals indicate like elements throughout the several views, there are shown in FIGS. 1 through 11 various embodiments of a heat exchanger assembly including a coaxial heat exchanger and condenser tee. The exchanger may be formed of a coaxial tubing with an inner tube formed of a corrosion resistant material such as titanium or stainless steel for example. Both of the inner and outer tubes may be formed of the corrosion resistant material in some embodiments. The condenser tee is joined to the inner tube material by a compression fitting or a high-pressure high temperature resin. The outer tube is joined to the condenser tee by a high-pressure high temperature resin or by brazing. The refrigerant tube is connected to the condenser tee by brazing or high-pressure high temperature resin.

Referring now to FIG. 1, a perspective view of a heat exchanger assembly 10 is depicted. The heat exchanger assembly 10 includes a first condenser tee 12 and second condenser tee 14. The tees 12, 14 may be formed of various materials as indicated including, but not limited to, copper, brass or combinations thereof. Further, the tee materials and other materials set forth herein should be understood to include alloys of the mentioned materials. Therefore the tees 12, 14 may also be formed of copper-alloys, brass-alloys, combinations of the alloys or any combination of the foregoing materials copper, brass, combinations thereof, alloys thereof or combinations of alloys. In the depicted embodiment, there are two first condenser tees 12 and two second condenser tees 14. Additionally, the heat exchanger assembly 10 comprises a coaxial heat exchanger 16. The heat exchanger assembly 10 receives a hot fluid $F_H$ and uses a cooler fluid $F_C$ to remove heat from the first hot fluid in the heat exchanger 16. The two fluids may be brought together at one end of the exchanger 16, for example condenser tee 12, without fluids mixing, and are separated at the second condenser tee 14. Alternatively, the fluids may enter the heat exchanger are opposite ends, if the two fluids are moving in opposite directions. In the depicted embodiment, there are two heat exchangers 16 and therefore two condenser tees 12 and two condenser tees 14 are utilized.

Each condenser tee 12, 14 brings together or separates a flow of cooling fluid $F_C$ and a second flow of refrigerant $F_H$ wherein the cooling fluid $F_C$ is utilized to reduce the temperature of the refrigerant $F_H$. The condenser tees 12, 14 have three ports wherein two ports receive or separate fluids and an additional port wherein the fluids are flowing coaxially. The term port is a general description and the terms "fluid inlet" and "fluid outlet" are more specific relative to fluid flow direction. However, it should be understood that the inlets and outlets are defined by the fluid directions traveling through the ports.

Each condenser tee 12, 14 comprises one of a first fluid inlet 20 and a first fluid outlet 22, respectively. The first fluid inlet 20 and the first fluid outlet 22 provide for flow of a first fluid through the heat exchanger 16. Further, the first fluid $F_C$ may be various types and according to some exemplary embodiments, the first fluid may be salt water. The salt water or seawater is a relatively more corrosive fluid which quickly wears or corrodes many materials which have been utilized with heat exchange mechanisms. In some embodiments, however, it is possible that the first fluid be an alternate fluid such as fresh water, for example if the marine craft is not utilized in salt water environments. Still further, any of these fluids, salt water, fresh water, or other, may also include various other constituents or particulates which may aid in the corrosive effect and/or wear of the heat exchanger, such as minerals, dirt, sand, shell materials or other particulates. The first cooling fluid inlet 20 and first cooling fluid outlet 22 are in flow communication with the first fluid source to form at least a portion of a first fluid circuit.

The condenser tees 12, 14 also comprise a second fluid inlet or port 24 (FIG. 3) and a second fluid outlet or port 26, respectively, for the second fluid, for example $F_H$. The second fluid may be a refrigerant such as R410A. Other fluids however may be utilized such as, for non-limiting example, commercially available R407C, R404A. The condenser tees 12, 14 connect to refrigerant lines to form a refrigerant circuit.

It should be noted that while the first fluid is generally referred to as the cool fluid and the second fluid is generally referred to as the hot fluid, these are merely descriptions. The first and second fluids are not limited to cold and hot respectively, but may also be reversed.

The heat exchanger assembly 10 is provided in a form which allows fluid to move coaxially between the condenser tees 12, 14 and transfer heat. However, the two fluids do not directly mix while in the heat exchanger. Instead, heat from the refrigerant $F_H$ is removed by way of conduction via the cooler first fluid $F_C$, for example the marine saltwater.

As shown, the heat exchanger 16 is wrapped or coiled to increase the length of time of interaction with the two fluids. However the coil shape also does not unduly enlarge the footprint of the assembly 10. The shape of the coils is generally rectangular with curved corners. However other shapes, such as square with curved corners or circular wraps may be utilized. The coil shape has an interior side within the wrap and an exterior side outside the wrap. Further, the heat exchange may occur by one or more heat exchangers 10, as shown.

Referring still to FIG. 1, a second heat exchanger assembly 11 is shown beneath the assembly 10. Depending on the cooling capacity desired, one or more heat exchanger assemblies may be utilized in series or parallel arrangement. Like the heat exchanger assembly 10, the heat exchanger assembly 11 also includes condenser tees at ends of the heat exchanger 16. Thus, the parts will not be described again.

In connecting the heat exchanger assemblies 10, 11 are connected in flow communication at the tees 12, 14 by a plurality of manifolds 13, 15, 17, 19. These manifolds may be U-shaped and/or T-shaped when there are only two assemblies 10, 11 or when there are more than two assemblies 10, 11. However, they may be alternatively shaped if additional heat exchangers are used making the flow between the heat exchanger assemblies in parallel or maintaining them in series as shown.

Figure 2:
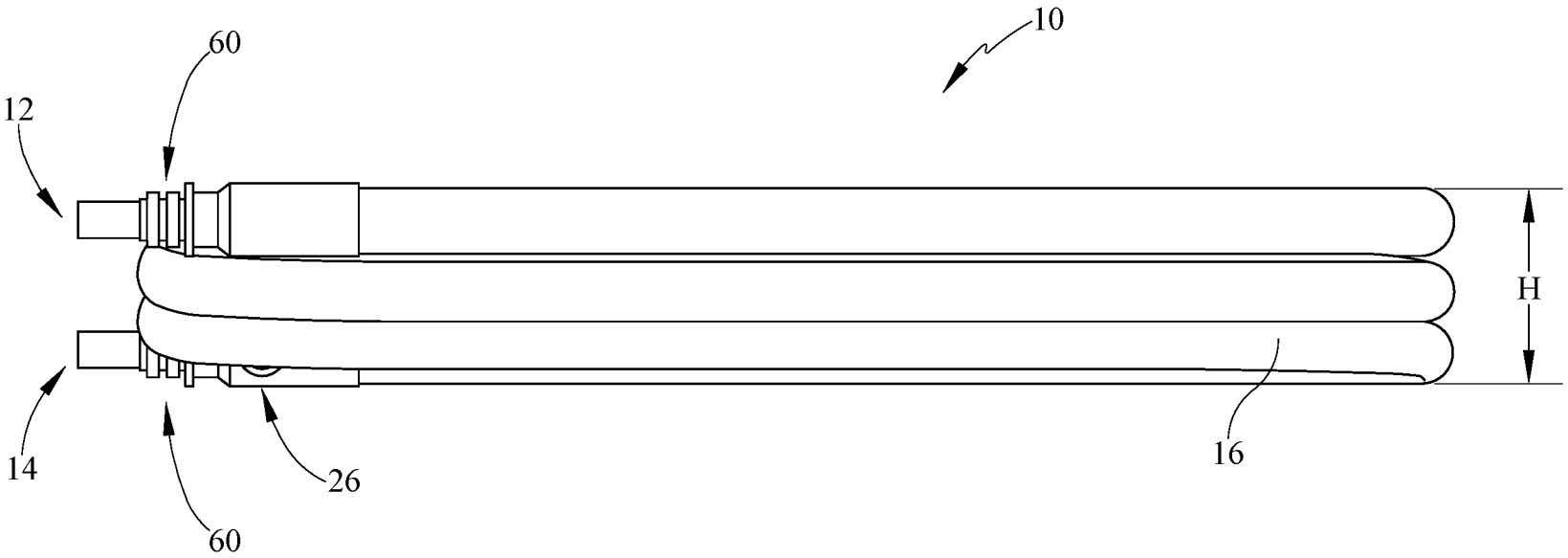
FIG. 2 is a side view of the heat exchanger assembly of FIG. 1.

Referring now to FIG. 2, a side view of the heat exchanger assembly 10 is shown. In many environments, such as for example marine environments, space is of high-value and it is desirable to reduce the footprint of mechanical service structures within a craft. The instant embodiments achieve this goal by orienting the condenser tees 12, 14 in such a manner, and having the condenser tees 12, 14 being sized, that refrigerant piping is maintained within the footprint of the heat exchanger assembly 10. Further, if a replacement assembly is required for an older heat exchanger, the instant structure will fit in the limited space despite the present design and new condenser tees.

With reference to the condenser tee 12, the second fluid port 24 (FIG. 1) cannot be seen extending from the opposite side of the tee 12 because the port 24 is sized to fit within the size and shape (i.e. footprint) provided by the tee 12. The sizing is desirable in order to reduce the overall footprint of the heat exchanger assembly 10. According to the instant embodiment, the port 24 enters the tee 12 at about 90 degrees to the port 20 for the first fluid. The angle of the port 24 may change relative to the port 20. However, it may be desirable to maintain the orientation wherein the port 24 opens toward an interior of the coil of the heat exchanger assembly 10. This will reduce the footprint of the assembly 10. Alternatively, it may be desirable to orient the port 24 at about 180 degrees from the position shown to maintain the footprint characteristics.

Further, in some embodiments, the assembly 10 comprises a compression fitting 60 at each tee 12, 14 which allows for the coil shape but does not create sizing, which unnecessarily bulges the ends of the exchanger 16 away from the remaining coils of the heat exchanger 16 and otherwise precludes space saving design of the assembly 10. This also aids in replacement of older heat exchanger assemblies with new assemblies having the compression fittings without altering dimensions.

As shown in FIG. 2, the heat exchanger assembly 10 is formed such that the heat exchanger 16 coils and has a coiled height H which is dependent upon the diameter of the heat exchanger 16 and the number of coils. Additionally, the condenser tees 12, 14 are sized to be of substantially similar diameter to the heat exchanger 16 so that the tees 12, 14 are not substantially oversized relative to the coaxial tube defining the heat exchanger 16.

The number of coils and the sizing of the heat exchanger 16 may be determined in part by the amount of heat reduction needed from the heat exchanger assembly 16. One skilled in the art will recognize this is a non-limiting design factor in the development of the heat exchanger assembly 10.

With reference to both FIGS. 1 and 2, one advantage of some embodiments may be discerned. The use of a compression fitting would in some circumstances change the sizing of each condenser tee joint, for example this might increase the height dimension H by some amount, for example by one-half inch per heat exchanger assembly in some embodiments. Thus when multiple heat exchanger assemblies are stacked upon one another, the increase in height is multiplied by the number of heat exchangers used. This can be a multiple of various factors, as some systems may use stack of 10 or more heat exchanger assemblies for example.

In the tight quarters of marine craft where these heat exchangers might be used, the increase in dimension per heat exchanger assembly could result in an increase of several inches when replacing multiple heat exchangers. The present embodiments utilize the compression fitting in a manner which does not create a large increase in dimension so that the present embodiments may be used to replace existing units without increasing size and creating dimensional issues.

Figure 3:
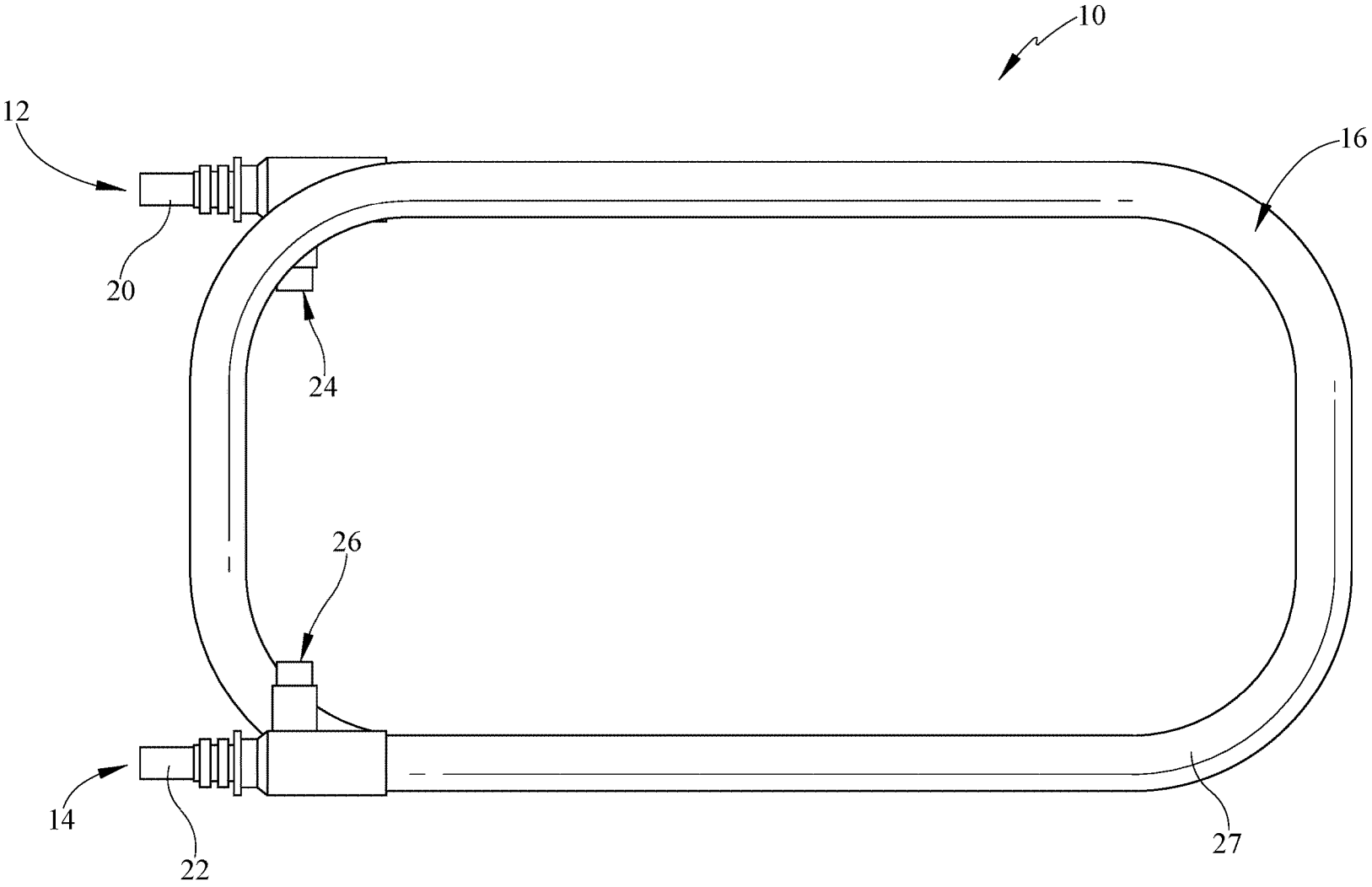
FIG. 3 is a top view of the heat exchanger assembly of FIG. 1.

Referring now to FIG. 3, a top view of the heat exchanger assembly 10 is shown. The heat exchanger 16 is formed in the shape of a rectangle with curved corners. Various shapes may be utilized to define the coil shape including square, circular, other geometric shapes including, but not limited to polygons or other nondescript coil shapes.

One skilled in the art will understand that for a given amount of heat needing to be removed from a refrigerant, the length of the heat exchanger 16 and therefore the coil 27, may be shortened by varying the diameter of the heat exchanger 16 or, the length of the heat exchanger 16 may be varied. Alternatively, multiple heat exchangers may be used by connecting the refrigerant and water ports in parallel, physically stacking the heat exchangers vertically or otherwise. The condenser tee design allows this while minimizing the overall height "H" (FIG. 2).

Also shown in FIG. 3 are the first fluid inlet and outlet 20, 22 in the second fluid inlet and outlet 24, 26. According to the instant embodiment, marine salt water may define the first fluid in some embodiments and the second fluid may be a refrigerant, for example R410A. The first fluid may enter the assembly 10 at inlet 20 at a first cooler temperature and exit at outlet 22 at a second higher temperature, due to heat gain from the second fluid. Oppositely, the second fluid may enter the tee 12 at inlet 24 at a first higher temperature and exit the second tee 14 at a lower second temperature due to heat transfer to the first fluid. It should be understood that for instance by reversing the flow of refrigerant $F_H$, the heat transfer direction may also be reversed in some embodiments.

According to some embodiments, the first fluid $F_C$ may travel through the assembly 10 in the same direction as $F_H$. However, in some embodiments, the fluid $F_C$ and the fluid $F_H$ may pass through the assembly 10 in opposite directions.

The heat exchanger 16 is a coaxial type having an inner tube or flow path and an outer tube or flow path. According to some embodiments, the first fluid $F_C$, for example salt water, passes through an inner flow path of the heat exchanger 16. Further, the refrigerant $F_H$ passes through an outer flow path of the heat exchanger 16. This differs from some prior designs where the higher pressure fluid generally flows through an inner tube and thus the outer flow path of the instant heat exchanger 16 should be capable of withstanding the high pressure requirements of the refrigerant without leaking. Thus, where plastics or lower strength materials could have been used in the prior art, the instant heat exchanger 16 utilizes higher strength material such as copper or brass, steel, bronze, alloys of any of the preceding or combinations of any of the preceding for the outer jacket 40. Further, the instant heat exchanger 16 is also formed of higher corrosion resistant material, higher strength stainless steel, titanium or copper-nickel alloy for the inner tube 42. The outer jacket may be brazed to the condenser tees 12, 14 in some embodiments and therefore the tees may be formed of copper, brass, steel, bronze, titanium or stainless steel, alloys of any of the preceding and combinations of any of the preceding. The inner tube or conduit 42 of the heat exchanger 16 may be formed of relatively higher corrosion resistant material, including, but not limited to, stainless steel or titanium, inclusive of alloys of either, and the outer jacket 40 may be formed of a relatively less corrosion resistant material, including but not limited to such as copper, brass inclusive of alloys of either. In some embodiments, as previously noted, both of the tubes or conduits of the heat exchanger 16 may be formed of the relatively more corrosion resistant material however such construction may be more expensive for a manufacturer.

With additional reference now to FIG. 2, the second fluid inlet and outlet 24, 26, shown in FIG. 3, are oriented to be positioned generally within the height H of the heat exchanger assembly 10. The second fluid, for example refrigerant, may be delivered to the condenser tees 12, 14 by some pipe or tube material including, but not limited to, copper piping or tubing. In the instant embodiment, the copper tubing which delivers refrigerant to and removes refrigerant from the heat exchanger 16 enters the condenser tees 12, 14 generally in the same plane as the coils 27 are wrapped which define the heat exchanger assembly 10. For example, when viewed from behind as in FIG. 2, the outlet 24 cannot be seen. This reduces the height footprint, or width depending on the orientation, of the heat exchanger assembly 10.

Figure 4:
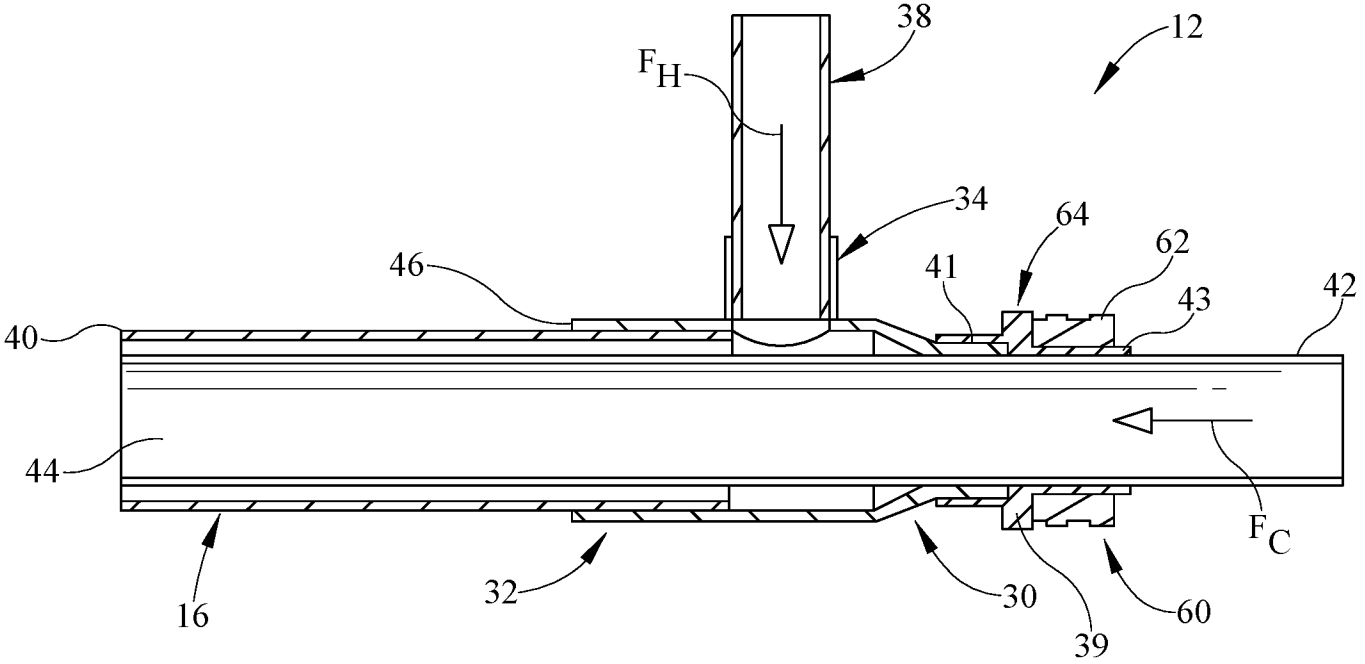
FIG. 4 is a section view of a portion of the heat exchanger assembly of FIG. 1.

Referring now to FIG. 4, a section view of a connection between the heat exchanger 16 and a condenser tee 12 is depicted. Since the condenser tee 12 is the same as condenser tee 14, the latter will not be described. The depicted portion of the assembly 10 (FIG. 1) includes the condenser tee 12 which includes three ports: a first port 30, a second port 32 and a third port 34. As noted, these ports may be fluid inlets or outlets depending on flow direction.

Referring initially to the third port 34, the second fluid tube 38 is received therein. The second fluid tube 38 defines a path for second fluid flow $F_H$ therein. The second fluid tube 38 may be formed of a copper or other suitable material, for example. The second fluid $F_H$ as previously described may be a refrigerant which is heated and cooled to remove heat from a volume or alternatively remove the heat from a fluid flow path such as an air duct. The refrigerant may move through the heat exchanger and additionally through a compressor (not shown) to provide the thermodynamic cycle required for the heat removal.

Beneath the third port 34 and further defining the condenser tee 12, are the first port 30 and the second port 32. The condenser tee third port 34 receives the second fluid $F_H$ through the second fluid tube 38. The first port 30 receives a first fluid $F_C$ by way of an inner tube or conduit 42, which defines a portion of the heat exchanger 16. The first fluid, for example sea water, flow path 44 defined by the inner tube 42. The heat exchanger 16 further comprises an outer tube or jacket 40 disposed around the inner tube 42. The heat exchanger 16, defined by the inner tube or conduit 42 and the outer tube or jacket 40 extend from the second port 32. Thus, the first fluid passes through the inner tube 42 in the second fluid passes through the second fluid tube 38 and both fluids passed through the heat exchanger 16 by way of the second port 32.

In the instant embodiment, it is desirable to maintain the small footprint characteristics, previously described. Since the tube 38 is formed of copper for example, the tube 38 may be brazed to the tee 12. Alternatively, the inner tube 42 is formed of a material which is resistant to the wear effects of salt water. Therefore a material such as, for non-limiting example, titanium or stainless steel may be utilized. Brazing titanium and stainless steel however is problematic. Accordingly a compression fitting 60 is provided which provides a sealing connection between the tee 12 and the inner tube 42 and also allows the small footprint size to be maintained.

The compression fitting 60 comprises an adapter 64 and a compression or locking ring 62. The adapter 64 includes a stop 39, a first flange 41 which connects to the first port 30 and second flange 43 which is on the opposite side of the stop 39 from the first flange 41. The first flange 41 engages the condenser tee 12 and the second flange 43 extends from the opposite side of the stop 39. The stop 39 is engaged by the port 30 on one side and provides a seat for a compression or locking ring 62 on the opposite side.

The second flange 43 also receives the locking ring 62. The locking ring 62 compresses the flange 43 against the inner tube 42 to seal the first port 30 and inhibit leakage of the second fluid from this side of the condenser tee 12. The inner tube 42 is formed of a corrosion resistant material, for example titanium or stainless steel, or a related alloy. The locking ring 62, and the adapter 64 which together define the compression fitting 60 may be formed of brass material, a related alloy, aluminum or steel, for non-limiting example. According to some embodiments, the inner surface of the locking ring 62 and/or the outer surface of the flange 43 may be tapered to aid in providing pressure on the tube conduit or tube 42. Additionally, or alternatively, a sealant may be utilized between the inner surface of flange 43 and the outer surface of inner conduit 42. The sealant in some embodiments may be an anaerobic sealant which occupies surface irregularities between the two surfaces.

The compression fitting 60 must be brazed or otherwise bonded to the tees 12, 14 or in the subsequent embodiments, to the outer jacket 40 of the heat exchanger. Thus, the adapter 64 may be formed of a braze compatible material with the tee or the outer jacket 40. The tees 12, 14 or the outer jacket 40 may be formed of various materials including but not limited to steel, copper, copper-nickel, brass, bronze titanium, stainless steel, or alloys of any of the preceding or any combination of the preceding including the alloys of the preceding. Accordingly, the adapter 64 may be formed of any of those materials or combinations of those materials.

At the opposite end of the heat exchanger 16, the second condenser tee 14 (FIG. 1) allows the first fluid and the second fluid to exit the heat exchanger assembly. The second condenser tee 14 includes three ports and is constructed similarly to the condenser tee 12.

Figure 5:
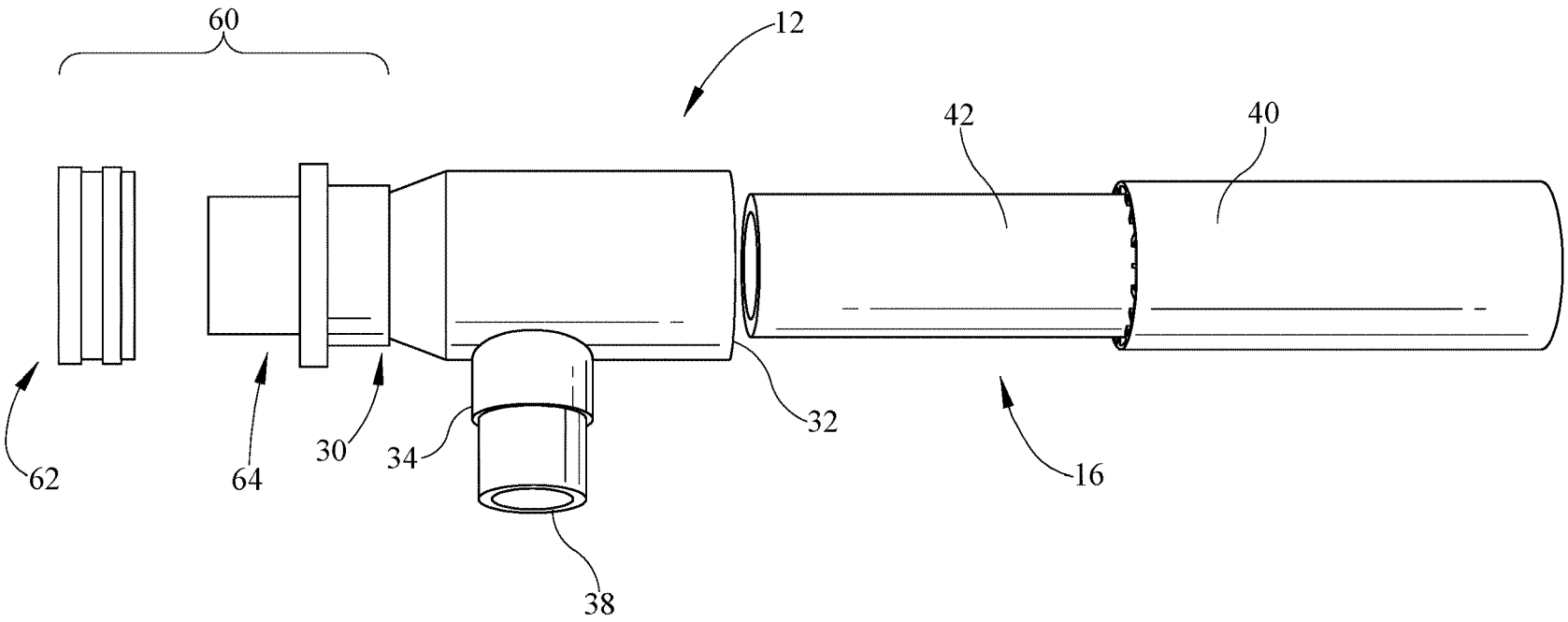
FIG. 5 is an exploded assembly view of the portion of the heat exchanger shown in FIG. 3.

Referring now to FIG. 5, an exploded view of the heat exchanger assembly 10 is depicted. In the depicted figure, the condenser tee 12 is shown to the left of the heat exchanger 16. The heat exchanger 16 is coaxial including the outer tube 40 and the inner tube 42.

The condenser tee 12 includes the first port 30, the second port 32 and the third port 34. The second port 32 is of a larger diameter than the first port 30. The diameter is larger since both the inner tube 42 and the outer tube 40 are received by and extend from the second port 32. Alternatively, the first port 30 is formed of a smaller diameter since only the inner tube 42 passes therethrough.

Extending at an angle to the first and second ports 30, 32 is the third port 34 which receives a tube 38 carrying the second fluid, for example refrigerant $F_H$. The angle of the third port 34 is depicted as perpendicular but other angles may be used. Further, the port 34 may also be in the same plane as the first and second ports 30, 32 to reduce footprint of the condenser tees 12, 14 and the heat exchanger assembly 10. The tube 38 may be formed of various materials, for example copper.

In this view, one skilled in the art will understand that the refrigerant is received into the tee 12 and passes through the outer tube 40 along the outer surface of the inner tube 42.

Also shown at the first port 30 is a compression fitting 60 through which the inner tube 42 passes upon assembly. The compression fitting 60 allows a sealing connection of the first port 30 and the inner tube 42 which may be formed of corrosion resistant material, for example titanium or stainless steel, which is difficult to, or otherwise may not be, brazed. The inner tube 42 extends through the tee 12 when the components are assembled and through the first port 30. The compression fitting 60 includes an adapter 64 which may be formed of brass or copper for example and is brazed to the compression tee 12 at the first port 30. When the adapter 64 is positioned on the first port 30, the inner tube 42 of the heat exchanger 16 also passes through the adapter 64 and the compression ring 62 is positioned over the adapter 64. This tightens the inner tube 42 by way of interference fit. The interference fit may be sliding, rotating such as by thread, or other interfering forms of engagement. The outer surface of tube 42 and/or the inner surface 43 may also receive a sealant to seal between the surface irregularities of the dissimilar metals. Such sealant may be an anaerobic sealant and may be disposed in a variety of methods as a thin layer which retains some amount of flexibility upon curing or otherwise drying or hardening.

Various compression fittings may be utilized including screw type interference fit, linear sliding, combination thereof or others or the like so that the inner tube 42 is sealed relative to the condenser tee 12 and so that the second fluid does not leak from the condenser tee 12 where the inner tube extends. Thus depending on whether condenser tee 12 or 14 is described, the second fluid, for example refrigerant, is directed into the outer tube 40 from the third port 34 or out of the third port 34 from the outer tube 40. Further, in some embodiments, the assembly may be capable of withstanding temperatures above 150° F. and in some embodiments, for example up to 250° F. The fitting and the assembly as a whole may also withstand pressure of up to, according to some non-limiting examples, 2375 psig.

With brief reference again to FIG. 4, the tee 12 is shown with the adapter 64 connected to the first port 30. The inner tube 42 extends through the tee 12 and joins the outer tube near the port 32.

Figure 6:
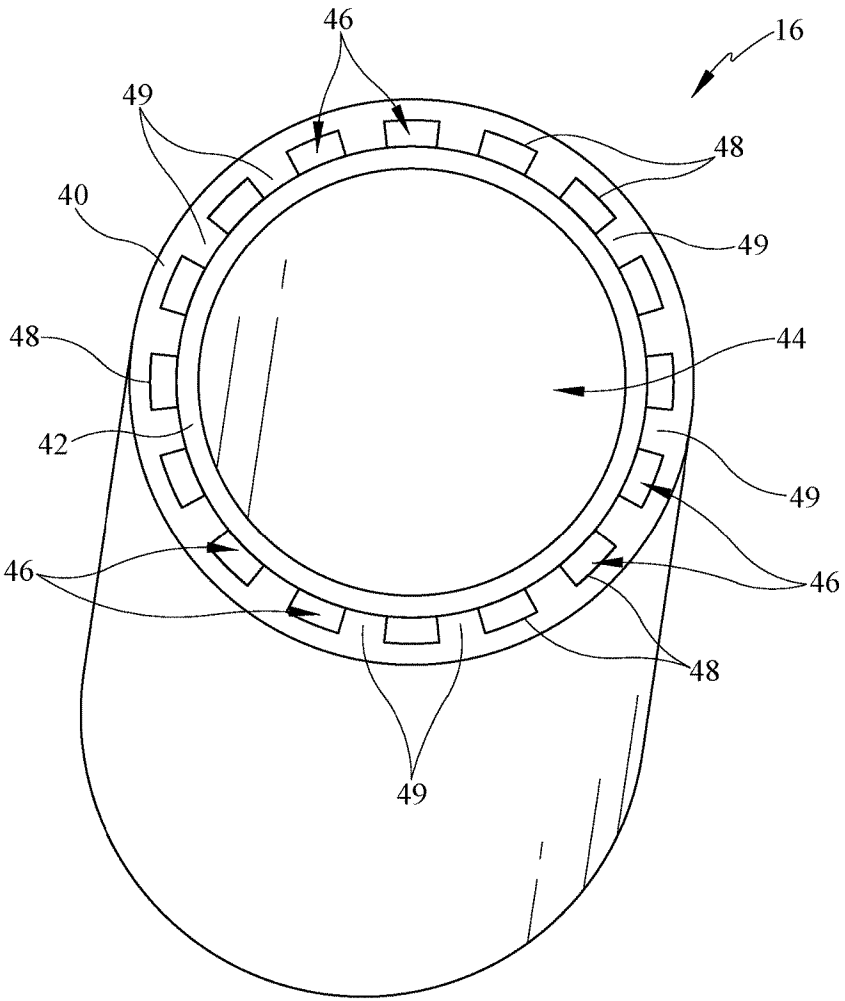
FIG. 6 is an end view of the coaxial tube of the instant embodiments.

Referring now to FIG. 6, a sectioned perspective view of the heat exchanger 16 is shown. The inner tube 42 is surrounded by the outer tube 40 providing an inner flow path 44 and an outer flow path 46 through the respective tubes. In the present embodiments, it is desirable that the inner tube 42 be formed of a corrosion resistant material such as titanium or stainless steel so that corrosive salt water may pass through the inner tube.

The outer tube 40 may be formed of various materials including, but not limited to, stainless steel, titanium, copper and the like which are suitable to allow high pressure refrigerant to pass therethrough. The heat exchanger 16 may be formed in a plurality of manners including but not limited to forging, extrusion, co-extrusion, some combination thereof or other manners such as for example, by forming the tubes separately and forcing them together.

The outer flow path 46 may be formed of one or more partitions 48. A plurality of partition walls 49 connect the outer tube 40 to the inner tube 42. The outer tube 40 is provided some strength due to the partitions in addition to the materials used for the tube 40.

When viewed in section as shown in FIG. 6, the partitions 48 may be formed of any of various shapes. The partitions 48 in the some embodiments are generally four sided, and may be square, rectangular, or some other shape. Some embodiments, as depicted, may have more than four sides or less than four sides. Further, one or more of these sides may be linear or curved between adjacent sides. Still further, the partition walls 49 are shown extending radially, but in some embodiments may be at an angle to a radially extending direction. The partitions walls 49 may be linear or may be curved depending on the adjacent side of the partition 48.

Figure 7:
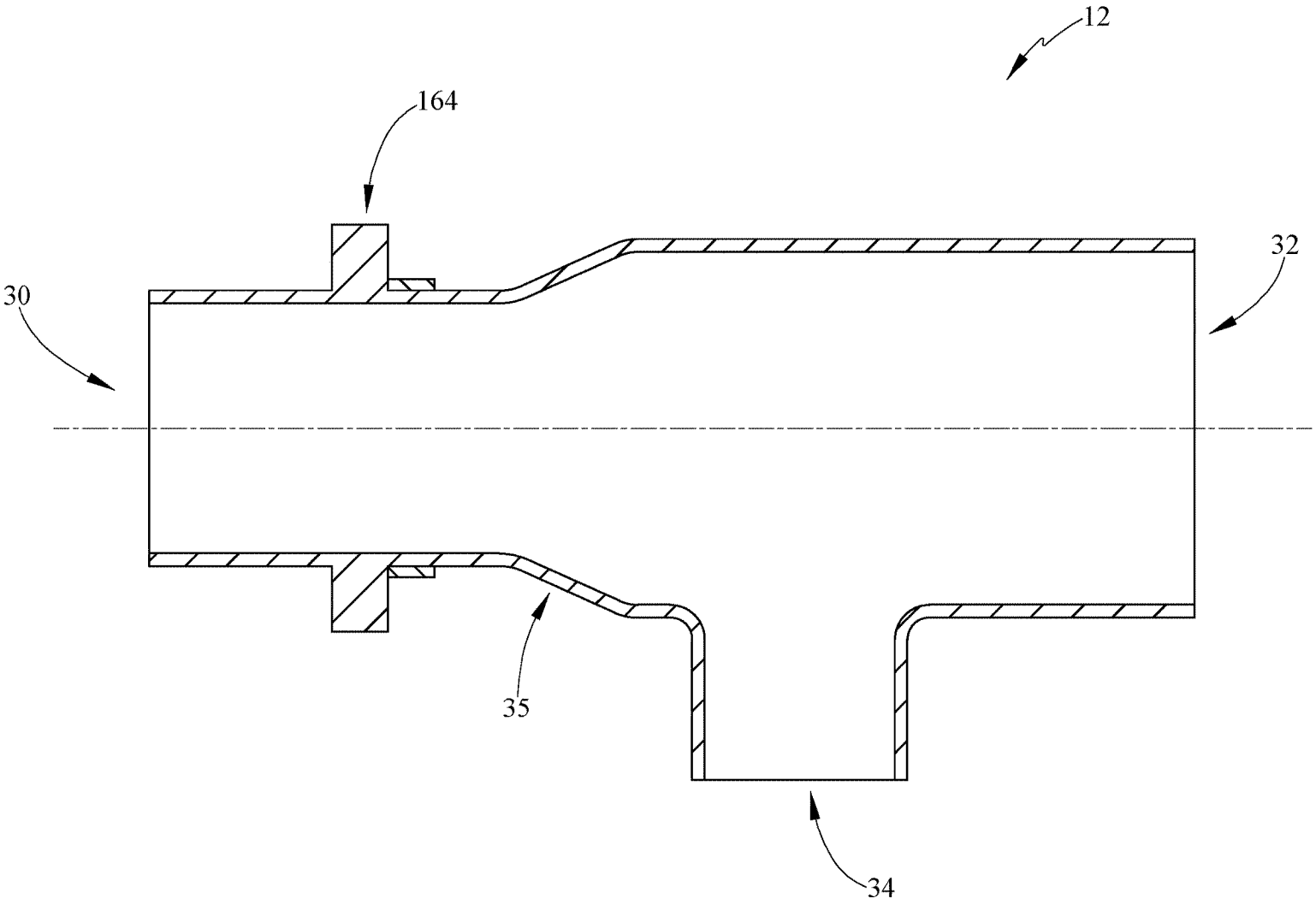
FIG. 7 is a section view of the condenser tee.

Referring now to FIG. 7, a side section view of an exemplary condenser tee 12, 14 is shown. The tee 12 has three ports 30, 32, 34. The condenser tees 12, 14 may be formed of copper or other metallic structures capable of being brazed or otherwise bonded by resins and capable of withstanding high temperature and pressure associated with refrigerant used in cooling systems.

The first port 30 is smaller than the second port 32. The second port 32 receives the heat exchanger 16 having the inner tube 42 and the outer tube 40. In the depicted embodiment, the second port 32 is oriented to the right hand side of the Figure. The heat exchanger 16 enters on the second port 32 side of the condenser tee 12 and the inner tube 42 extends through the first port 30.

The condenser tee 12 also comprises a neck region 35. In this neck region 35, the diameter of the condenser tee 12 changes or tapers from the larger diameter at the second port 32, to the smaller diameter of the first port 30. As shown, the taper is substantially linear but may also be curved as well. One skilled in the art should also realize that while the second port 32 is labeled as larger than the first port 30, the opposite is also available wherein the first port may be larger and the second port may be smaller.

Near the neck region 35 along the smaller diameter is an adapter 164 which extends circumferentially about the body of the condenser tee 12. The adapter 164 may be formed integrally with the condenser tee 12 which differs from the previous embodiment which included an adapter which is slidably positioned on and brazed to the tee 12.

Once the adapter 164 is formed on, or joined to (64), the condenser tee 12, the adapter 64, 164 may be used to position the compression fitting 60. Further, in either embodiment, the adapters 64, 164 may vary in diameter between a first diameter which engages the outer jacket 40 and a second diameter which engages the inner conduit. In other words, the first flange 41 may have a first diameter and the second flange 43 may have a second diameter each corresponding to the diameters of the outer jacket 40 and inner conduit 42. Or, the adapters 64, 164 may vary, for example taper, between the first and second diameters. Either of these embodiments may be used in alternative to for example tapering the outer jacket from a first diameter to a second diameter and using a single diameter size for the tee. Still further, another embodiment may include having two diameters defined by a port of the tee. Or still further, the adapter 64, 164 may provide for the two diameters or variation therebetween. All of these embodiments provide a structure for accommodating the difference between an outer jacket diameter and an inner conduit diameter of the heat exchanger. By accommodating the change in diameter of the outer jacket and inner conduit at the adapter 64, 164 rather than the tee 12, 14, the tees do not need to be manufactured with the varying diameter or tapered regions described. In still further embodiments, both of the adapters 64, 164 and the tees 12, 14 may have varying diameters to accommodate the difference in diameter between the outer jacket 40 and the inner conduit 42.

Extending from the body of the condenser tee 12 is the third port 34. During operation, a second fluid such as refrigerant is delivered into the condenser tee 12 through the third port 34. The third port 34 receives a pipe suitable for transfer of the second fluid type. For example in some embodiments, copper or other suitable materials may be utilized. The pipe or tube may be brazed to the third port 34 to seal the pipe or tube. With the heat exchanger 16 located in the second port, the inner tube 42 is exposed to the refrigerant, which flows into the heat exchanger 16 by moving through the partitions 48 between the inner tube 42 and the outer tube 40.

Figure 8:
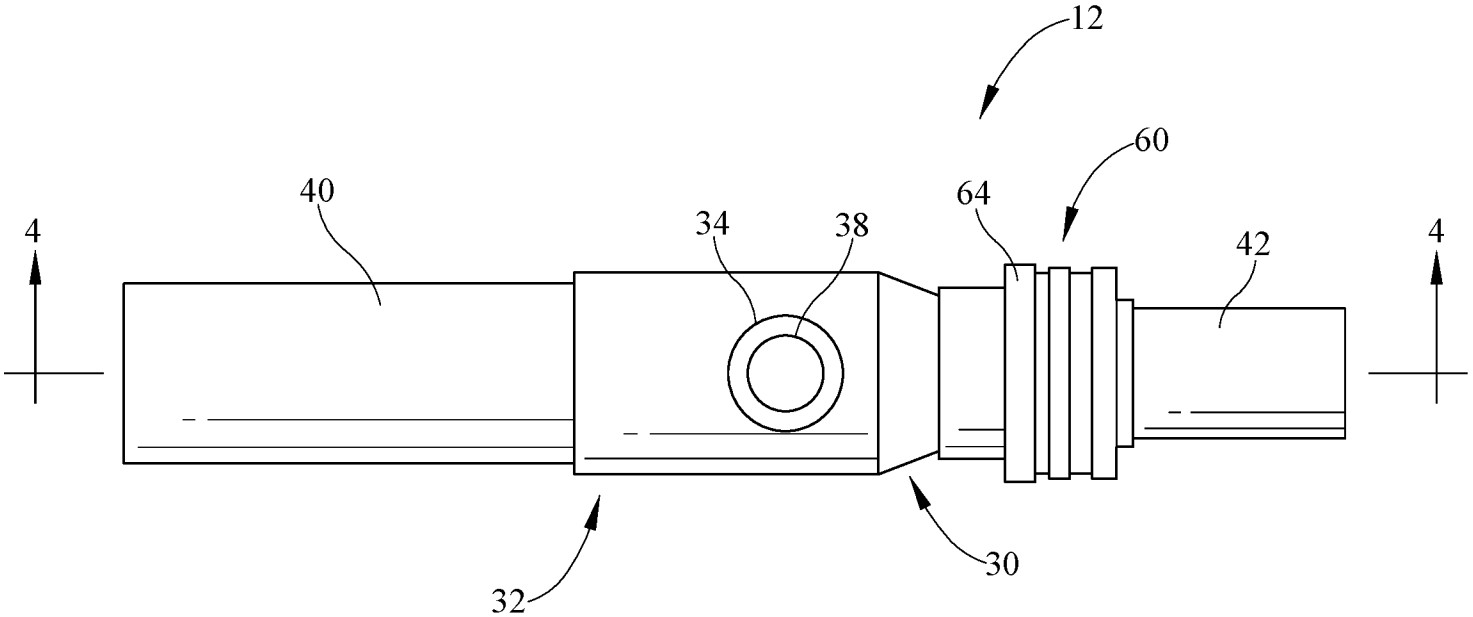
FIG. 8 is a top view of the condenser tee with a heat exchanger.

Referring now to FIG. 8, a top view of the condenser tee 12. The view is provided primarily for discussion of the adapter 64. The adapter 64 is connected to the first port 30 and may be brazed to the condenser tee 12. The inner tube 42 is shown extending from the condenser tee 12 and from the adapter 64.

In an alternate embodiment, the high pressure, high temperature resin may be utilized at two or more of the ports 30, 32, 34. For example, where the compression fitting 60 is used, the second and third ports 32 and 34 may be brazed or may be joined by high temperature high pressure resin. Alternatively, the first port 30 may be joined to the inner tube 42 by a high pressure high temperature resin.

Figure 9:
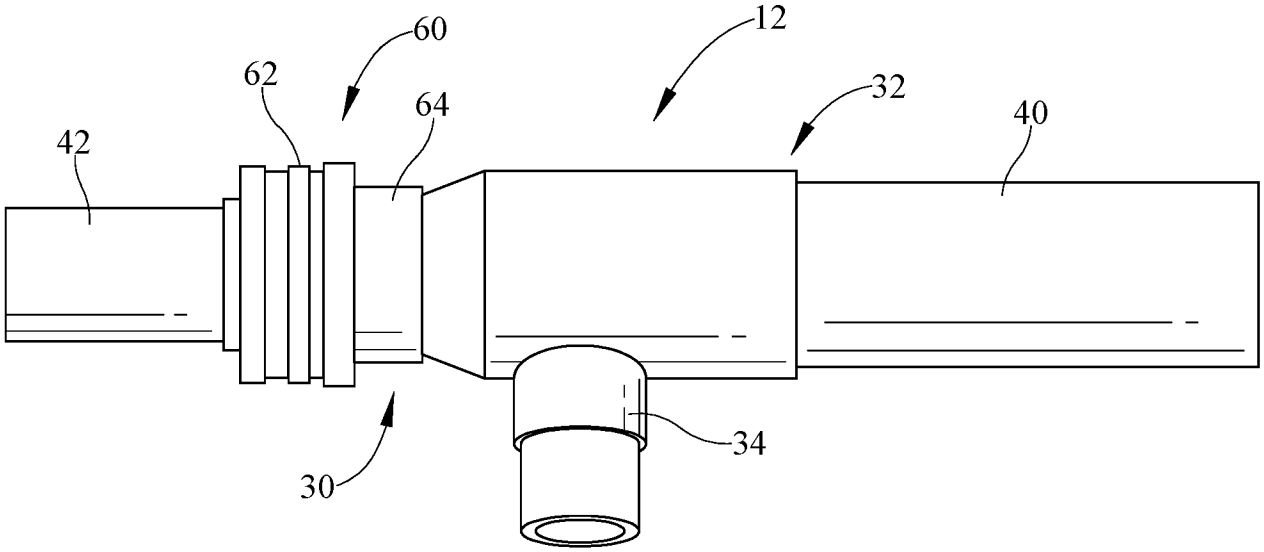
FIG. 9 is a side view of the condenser tee with the heat exchanger.

Referring to FIG. 9, a side view of the exemplary tee 12 is shown in an assembled view. The heat exchanger 16 extends into the tee 12 at the second port 32 and the inner conduit or tube 42 extends from the first port 30 through the compression fitting 60. The third port 34 extends from the tee 12 at an angle to the first and second ports 30, 32 and in plane with the first and second ports, so not to create an oversized or increased footprint issue. The assembly allows for brazing or high temperature and pressure resin at the second and third ports 32, 34 while the compression fitting is used at the first port 30.

Figure 10:
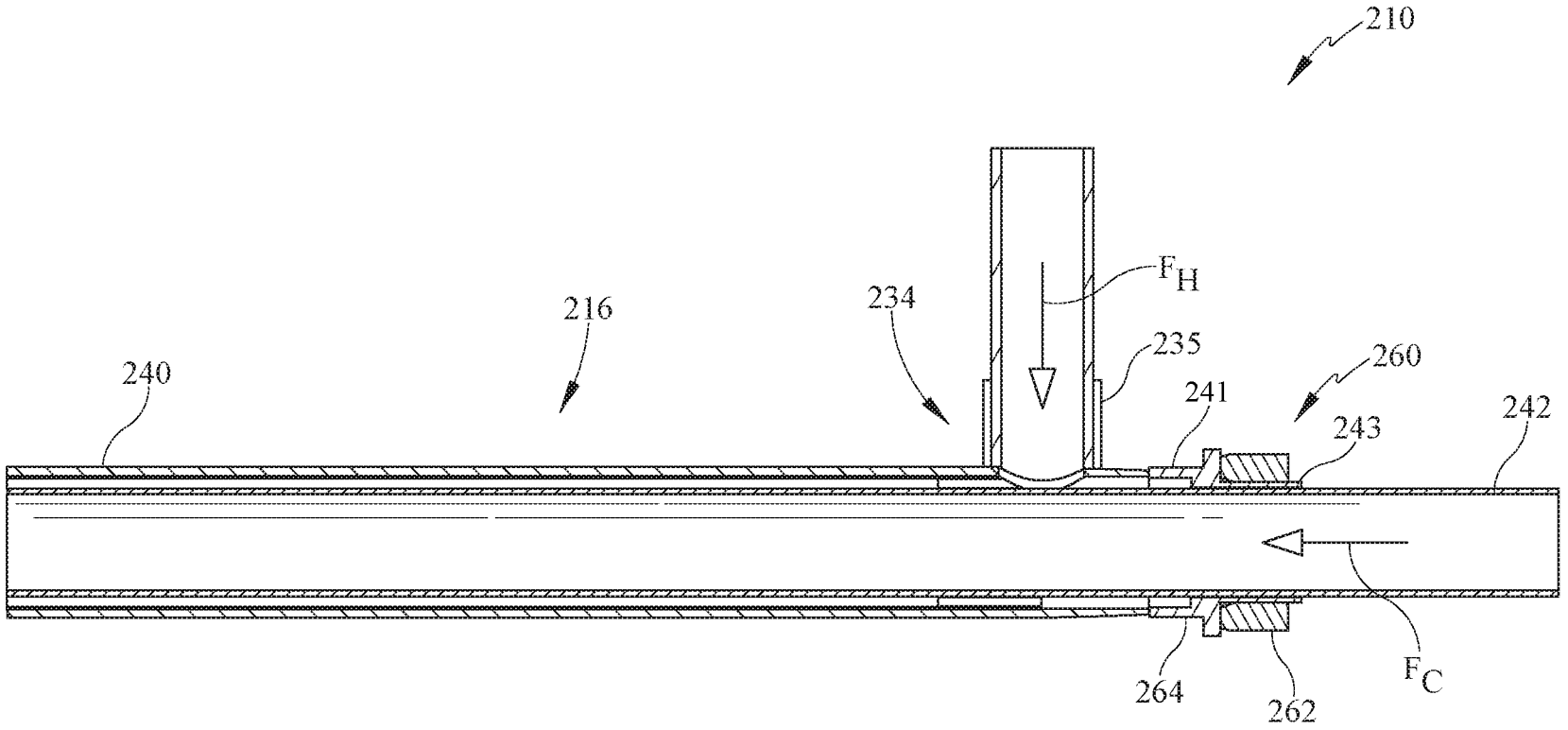
FIG. 10 is a section view of an alternate embodiment of the heat exchanger assembly; and, FIG. 11 is an upper perspective view of the embodiment of FIG. 10.

With reference now to FIG. 10, a further embodiment is provided in top section view. In this embodiment, the heat exchanger assembly 210 is partially shown and differs from the previous embodiment in that the tee is not necessary. Instead, the instant embodiment provides for application of a compression fitting 260 directly to the heat exchanger 216.

In this embodiment, the heat exchanger 216 as with previous embodiments comprises a first outer jacket 240 and a second inner conduit or tube 242. Further, as with the previous embodiments, the outer jacket 240 may be formed of a less corrosion resistant material, such as for non-limiting example, steel, copper or copper alloy, copper nickel, brass, bronze, titanium, stainless steel or alloys of any of the preceding or combinations of any of the preceding including the alloys. The inner conduit 242 may be formed of a relatively more corrosion resistant material such as for non-limiting example, a stainless steel, titanium, alloys of either or combinations of any of such.

The outer jacket 240 may comprise a port 234, which in some embodiments defines a location for a refrigerant. The port 234 may be defined by a hole or alternatively may further comprise a fitting or coupling 235, which may include elbows, disposed about the hole. Such fitting may further comprise scallops in order to better fit about the curvature of the outer jacket 240, as will be understood by one skilled in the art. The outer jacket 240 may also include a plurality of partition walls as in the previous embodiments.

The inner conduit or tube 242 is formed of the higher corrosion resistant material for fluid flow of for non-limiting example, salt water, sea water, or other fluid which may be more corrosive than fresh water and/or may include particulate which can result in corrosion.

With the use of port 234, a fluid, such as refrigerant, can flow inside the outer jacket 240 and along the inner conduit 242 to transfer energy with the fluid passing through the inner conduit 242. According to some embodiments, the salt water $F_c$ is cooler than the incoming refrigerant $F_H$ so that the refrigerant is cooled by the salt water.

Further, the instant heat exchanger assembly 210 includes a compression fitting 260 which as previously described comprises an adapter 264 and compression or locking ring 262. In this embodiment, the use of a tee is not necessary as the compression fitting is directly connected to the heat exchanger 216. Since the heat exchanger has two diameters corresponding to the outer jacket 240 and the inner conduit 242, the adapter 264 or heat exchanger 216 may be formed in various ways to connect.

In some embodiments, the heat exchanger 216, specifically, the outer jacket may have a varying diameter between a first larger diameter and a second smaller diameter. This allows for change from the larger size of the outer jacket 240 to the smaller size of the adapter 264. This variation may be constructed in various ways and according to some embodiments may be a tapered connection. Alternatively, rather than changing the diameter of the outer jacket 240, the diameter of the adapter 264 may be formed to vary from a first size wherein the outer jacket 240 is engaged to a second diameter wherein the inner conduit 242 is engaged.

The adapter 264 may be engaged to the heat exchanger 216 in a variety of ways. In the depicted embodiment, the adapter 264 may be abutted to the heat exchanger outer jacket 240 and brazed or otherwise bonded for non-limiting example with a resin. In other embodiments, the adapter 264 may be slidably positioned over the outer jacket 240 as shown in previous embodiments and subsequently brazed or bonded.

With reference again to the adapter 264, a first flange 241 and a second flange 243 are shown. The first flange 241 has a first diameter and the second flange 243 has a second diameter, which is smaller than the first diameter. The larger first diameter of flange 241 engages the heat exchanger 216 and the smaller second diameter engages the inner tube 242. In this embodiment, the first and second diameters are distinct. However, in other embodiments, the adapter may vary from the first to the second diameter, for example by tapering as shown in the tees of the previous embodiments.

The compression or locking ring 262 is applied to the adapter as previously described to tighten the adapter against the inner tube or conduit 242.

Figure 11:
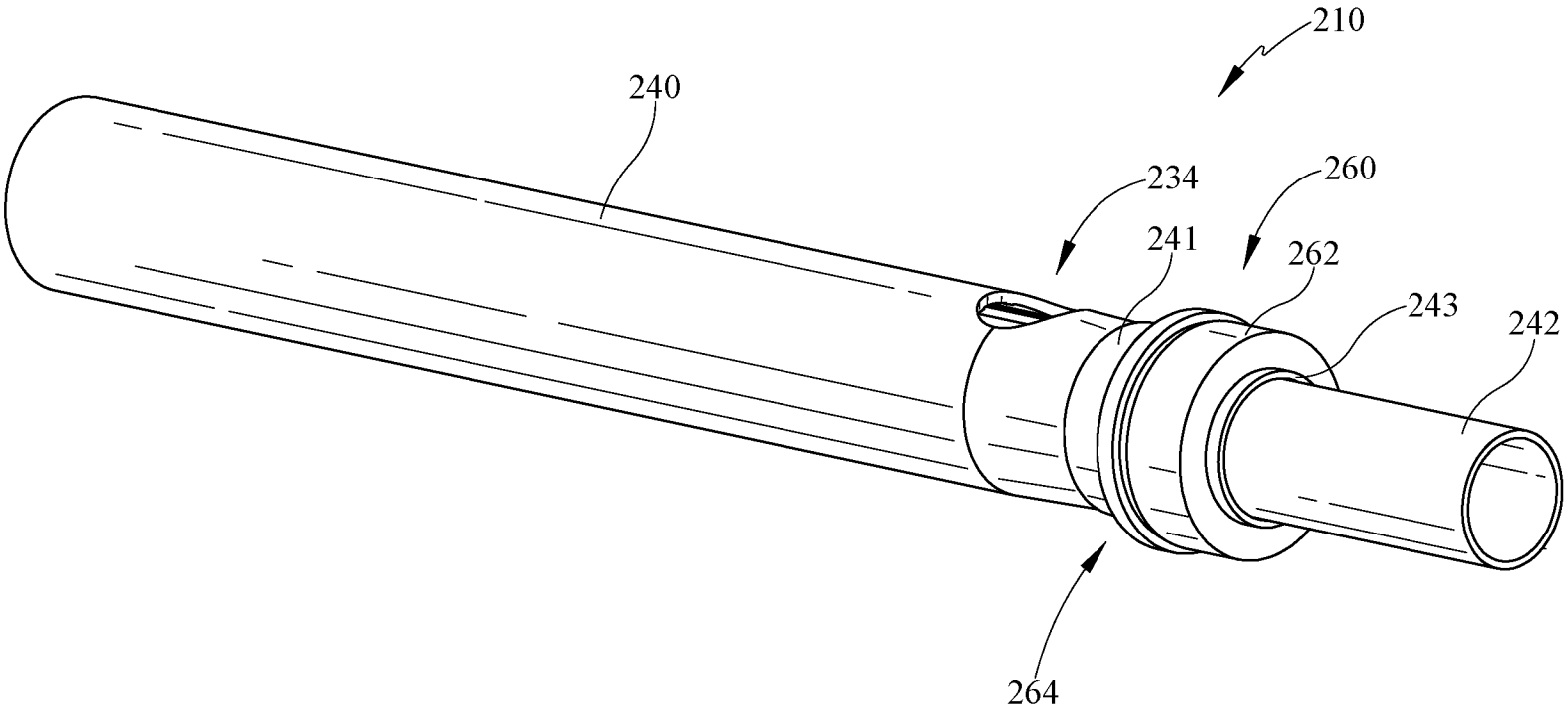

Referring now to FIG. 11, an upper perspective view of the heat exchanger assembly 210 is shown. The heat exchanger 216 is shown with the port 234 and having no coupling, fitting or elbow. In this embodiment, the first diameter of the first flange 241 is positioned on the outer jacket 240 and the second diameter of the second flange 243 is engaging the inner tube or conduit 242.

As previously indicated, the outer jacket 240 of the heat exchanger 216 may be tapered to cooperate or engage with the adapter 264. However, it may be more desirable for manufacturing purpose to accommodate the difference in the diameters of the outer jacket 240 and inner conduit 242 with the adapter 264. Therefore the adapter 264 may be formed to utilize the two distinct diameters or may comprise a taper between the first and second diameters of the flanges 241, 243.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the invent of embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases.

Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

The foregoing description of methods and embodiments has been presented for purposes of illustration. It is not intended to be exhaustive or to limit the invention to the precise steps and/or forms disclosed, and obviously many modifications and variations are possible in light of the above teaching. It is intended that the scope of the invention and all equivalents be defined by the claims appended hereto.

The invention claimed is:

1. A coaxial heat exchanger assembly, comprising:

a one-piece tee formed of one of copper, or copper-alloy, or brass, or brass-alloy, or a combination of copper and brass, or a combination of copper-alloy and brass-alloy, or a combination of any of the foregoing, said tee having a first port, a second port and a third port;

one of said first port or said second port having a tapered portion which tapers in diameter from a larger size to a smaller size, said tapered portion formed integrally with said tee, and wherein said one of said first port or second port comprises an interference fit compression fitting;

said third port receives a refrigerant tube;

the other of said first port or second port receives a coaxial heat exchanger including an inner conduit of a first material which is relatively more resistant to corrosion, and an outer jacket of a second material which is relatively less resistant to corrosion;

said compression fitting comprising an adapter disposed about an outer surface of said smaller size of said tapered portion, said adapter having a stop, a first flange extending in a first direction from said stop and a second flange extending in a second direction from said stop, said first flange having an inner dimension that differs from said second flange;

a ring disposed over said second flange, wherein the second flange passes through said ring;

an anaerobic sealant disposed on an inner surface of said second flange;

wherein said refrigerant tube provides a refrigerant to flow on an outside of said inner conduit, and wherein said inner conduit is configured to receive a more corrosive fluid;

wherein said inner conduit extends through said tee and said first port and said compression fitting is free of a brazing of said inner tube to said tee, while said second port and said third port comprise at least one of brazing or a high temperature high pressure resin.

2. The coaxial heat exchanger assembly of claim 1, further wherein said assembly is capable of withstanding temperature above 150° F.

3. The coaxial heat exchanger assembly of claim 2, said assembly having a burst pressure of at least 500 psig and up to 2375 psig.

4. The coaxial heat exchanger assembly of claim 1, said third port extending from said condenser tee in plane of the first and second ports.

5. The coaxial heat exchanger assembly of claim 1, said third port extending from said tee at about 90 degrees to said first and second ports.

6. The coaxial heat exchanger assembly of claim 5, said third port extending toward an interior of a coil shape defined by said heat exchanger.

7. The coaxial heat exchanger assembly of claim 1 wherein said corrosive fluid is saltwater and said saltwater flows in a first direction through said heat exchanger and said refrigerant flows in said first direction.

8. The coaxial heat exchanger assembly of claim 1, wherein said corrosive fluid is saltwater and said saltwater flows in a first direction and said refrigerant flows in a second direction.

9. The coaxial heat exchanger assembly of claim 1, said outer jacket having a plurality of partitions.

10. The coaxial heat exchanger assembly of claim 9, said partitions defined by a plurality of partition walls.

11. The coaxial heat exchanger assembly of claim 10, said partition walls extending radially.

12. The coaxial heat exchanger assembly of claim 10, said partition walls extending at an angle to a radial direction.

13. A coaxial heat exchanger assembly, comprising:

a first one-piece condenser tee, a coaxial heat exchanger having a first end and a second end, said first end connected to said first condenser tee, and said second end connected to a second one-piece condenser tee;

said heat exchanger having an inner conduit formed of one of titanium, stainless steel or alloys thereof and an outer jacket of a material differing from said inner conduit;

said first and second condenser tees each having three ports wherein a first port is in flow communication with saltwater, a third port is in flow communication with a refrigerant and a second port is in flow communication with said heat exchanger wherein both of said saltwater and said refrigerant pass for heat exchange;

said second and third port being connected to said outer jacket and a tubing, respectively by one of high pressure high temperature resin or brazing;

said first port tapering to a smaller diameter and being connected to said inner conduit by a compression fitting comprising an adapter formed of a braze compatible material with said tees, and a compression ring which engages said adapter and seals said inner conduit to said adapter, said adapter having a first flange having a first diameter which engages said outer jacket and a second flange having a second diameter which engages said inner conduit wherein said second flange passes through said compression ring, said first flange extending from a stop in a first direction and said second flange extending in a second direction, said first and second inner diameters being different;

an anaerobic sealant disposed between the said second flange and said inner conduit.

14. The coaxial heat exchanger assembly of claim 13, said heat exchanger forming a coil shape.

15. The coaxial heat exchanger assembly of claim 14, said third port of said condenser tees extending inwardly of said coil.

16. The coaxial heat exchanger assembly of claim 14, said third ports extending in a plane of one of the conduit coils.

17. The coaxial heat exchanger assembly of claim 14, said third ports being one of perpendicular or non-perpendicular to said first and second ports.

18. The coaxial heat exchanger assembly of claim 13, said condenser tees having one of said ports tapering from a first diameter to a second diameter.

19. The coaxial heat exchanger assembly of claim 13, said adapter being brazed to said condenser tees.

20. The coaxial heat exchanger assembly of claim 13, said tees having a port which accommodates a change in diameter between the outer jacket to the inner conduit.

21. The coaxial heat exchanger assembly of claim 13, said adapter having a first diameter and a second diameter which accommodates a change in diameter between said outer jacket to said inner conduit.

22. The coaxial heat exchanger assembly of claim 13 wherein both of said tees and said adapter accommodate a change in diameter between the outer jacket and the inner conduit.

23. A coaxial heat exchanger assembly, comprising:

a first one-piece condenser tee;

a coaxial heat exchanger having a first end and a second end, said first end connected to said first condenser tee, and said second end connected to a second one-piece condenser tee;

said heat exchanger having an inner conduit formed of titanium and an outer jacket of a second material;

said first and second condenser tees each having three ports wherein a first port is in flow communication with a more corrosive fluid, a third port is in flow communication with a refrigerant and a second port is in flow communication with said heat exchanger wherein both of said more corrosive fluid and said refrigerant pass for heat exchange;

said second port and said third port being connected to the outer jacket and a tubing, respectively by one of high pressure high temperature resin or brazing;

said first port tapering from a first diameter to a second smaller diameter, said first port being connected to said inner conduit by a compression fitting comprising an adapter braze compatible with said condenser tee, and a compression ring which engages said adapter and seals said titanium inner conduit to said adapter, said adapter having a first flange which extends in a first direction and has a first diameter which engages said outer jacket and a second flange which extends in a second direction and has a second diameter which engages said inner conduit, an anaerobic sealant disposed between the said second flange and said inner conduit, wherein said first and second diameters differ, said second flange passing through said compression ring.

24. A coaxial heat exchanger assembly, comprising:

a first one-piece condenser tee, a coaxial heat exchanger connected to said condenser tee, said heat exchanger having tubing comprising an outer jacket and an inner conduit;

said heat exchanger having said inner conduit formed of one of titanium, stainless steel or alloys thereof and said outer jacket formed of copper or alloys thereof;

said first condenser tee having three ports wherein a first port is capable of flow communication with saltwater, a third port is in flow communication with a refrigerant and a second port is in flow communication with said heat exchanger wherein both of said saltwater and said refrigerant pass for heat exchange;

said second and third ports being connected to said heat exchanger and a refrigerant tubing, respectively by at least one of high pressure high temperature resin or brazing;

said first port having a tapered portion and being connected to said inner conduit by a compression fitting comprising an adapter which is braze compatible with an outer jacket of said coaxial heat exchanger, and a compression ring which engages said adapter and seals said inner conduit to said second port;

said adapter having a stop, a first flange extending in a first direction from said stop and a second flange extending in a second direction from said stop, said first flange having an outer dimension that differs from said second flange, an anaerobic sealant disposed on an inner surface of said second flange.

25. A coaxial heat exchanger assembly, comprising:

a coaxial heat exchanger having a first inner conduit formed of a first more corrosion resistant material and a second outer jacket formed of a second less corrosion resistant material;

a one-piece condenser tee which receives each of said first inner conduit and the second outer jacket independently;

said outer jacket varying from a larger diameter to a smaller diameter;

a port disposed in said outer jacket configured to receive a refrigerant conduit for fluid communication of a refrigerant with an outer surface of said inner conduit;

a compression fitting disposed on said smaller diameter of said outer jacket, said compression fitting comprising an adapter which engages said outer jacket in a first location and which engages said inner conduit at a second location;

a ring which is positioned on said adapter to tighten said adapter against said first inner conduit;

said compression fitting comprising said adapter disposed at said smaller size of said tapered portion having a stop, a first flange extending in a first direction from said stop and a second flange extending in a second direction from said stop, said first flange having an outer dimension that differs from said second flange;

an anaerobic sealant disposed between said second flange and said inner conduit.

26. The assembly of claim 25 further comprising a sealant disposed between said adapter and said inner conduit.

27. The assembly of claim 25, said adapter comprising said first flange which is connected to said heat exchanger and said second flange which is connected to said inner conduit by said ring.

28. The assembly of claim 25, wherein said first more corrosion resistant material is one of titanium, stainless steel or an alloy of at least one of titanium or stainless steel.

29. The assembly of claim 25 wherein said second less corrosion resistant material is one of copper or copper alloy.

30. A coaxial heat exchanger assembly, comprising:

a coaxial heat exchanger having a first inner conduit formed of a first more corrosion resistant material and a second outer jacket formed of a second less corrosion resistant material;

a one-piece condenser tee which receives said first inner conduit and said outer jacket independently;

a port disposed in said outer jacket configured to receive a refrigerant conduit for fluid communication of a refrigerant with an outer surface of said inner conduit;

a compression fitting comprising an adapter having a first flange extending in a first direction and having a first diameter and a second flange extending in a second direction and having a second diameter wherein said first diameter differs from said second diameter, said first diameter of said adapter brazed to said outer jacket at a first location and said second diameter engaging said inner conduit at a second location;

an anaerobic sealant disposed between said second flange and said inner conduit;

a ring which is positioned on said adapter to tighten said adapter against said first inner conduit.

* * * * *